United States Patent [19]

Rottmann

[11] Patent Number: 5,034,043

[45] Date of Patent: Jul. 23, 1991

[54] AIR SEPARATION WITH ARGON RECOVERY

[75] Inventor: Dietrich Rottmann, Munich, Fed. Rep. of Germany

[73] Assignee: Linde Aktiengesellschaft, Wiesbaden, Fed. Rep. of Germany

[21] Appl. No.: 483,142

[22] Filed: Feb. 22, 1990

[30] Foreign Application Priority Data

Feb. 23, 1989 [DE] Fed. Rep. of Germany ..... 3905521

[51] Int. Cl.[5] ..... F25J 3/04

[52] U.S. Cl. ..... 62/22; 62/24; 62/38

[58] Field of Search ..... 62/22, 24, 38

[56] References Cited

U.S. PATENT DOCUMENTS

| | | | |
|---|---|---|---|
| 3,079,759 | 3/1963 | Schilling | 62/22 |
| 3,127,260 | 3/1964 | Smith | 62/22 |
| 3,729,943 | 5/1973 | Petit | 62/22 |
| 4,057,407 | 11/1977 | Bigi | 62/22 |
| 4,790,866 | 12/1988 | Rathbone | 62/22 |
| 4,842,625 | 6/1989 | Allam et al. | 62/22 |

FOREIGN PATENT DOCUMENTS

3436897A1 4/1986 Fed. Rep. of Germany .

*Primary Examiner*—Ronald C. Capossela
*Attorney, Agent, or Firm*—Millen, White & Zelano

[57] ABSTRACT

An air separation system is provided comprising a double rectification column associated with a raw argon column, the latter being operated at a pressure substantially lower than the low-pressure part of the double column. A coupled turbine-compressor system is used: (a) to lower the pressure of the argon-containing gas entering a raw argon column from the low-pressure column; and (b) to compress evaporated liquid stemming from the high-pressure column which has been used to indirectly condense raw argon product at the top of the raw argon column. Also, a pump is employed to remove liquid from the bottom of the raw argon column and recycle it to the low-pressure column.

28 Claims, 1 Drawing Sheet

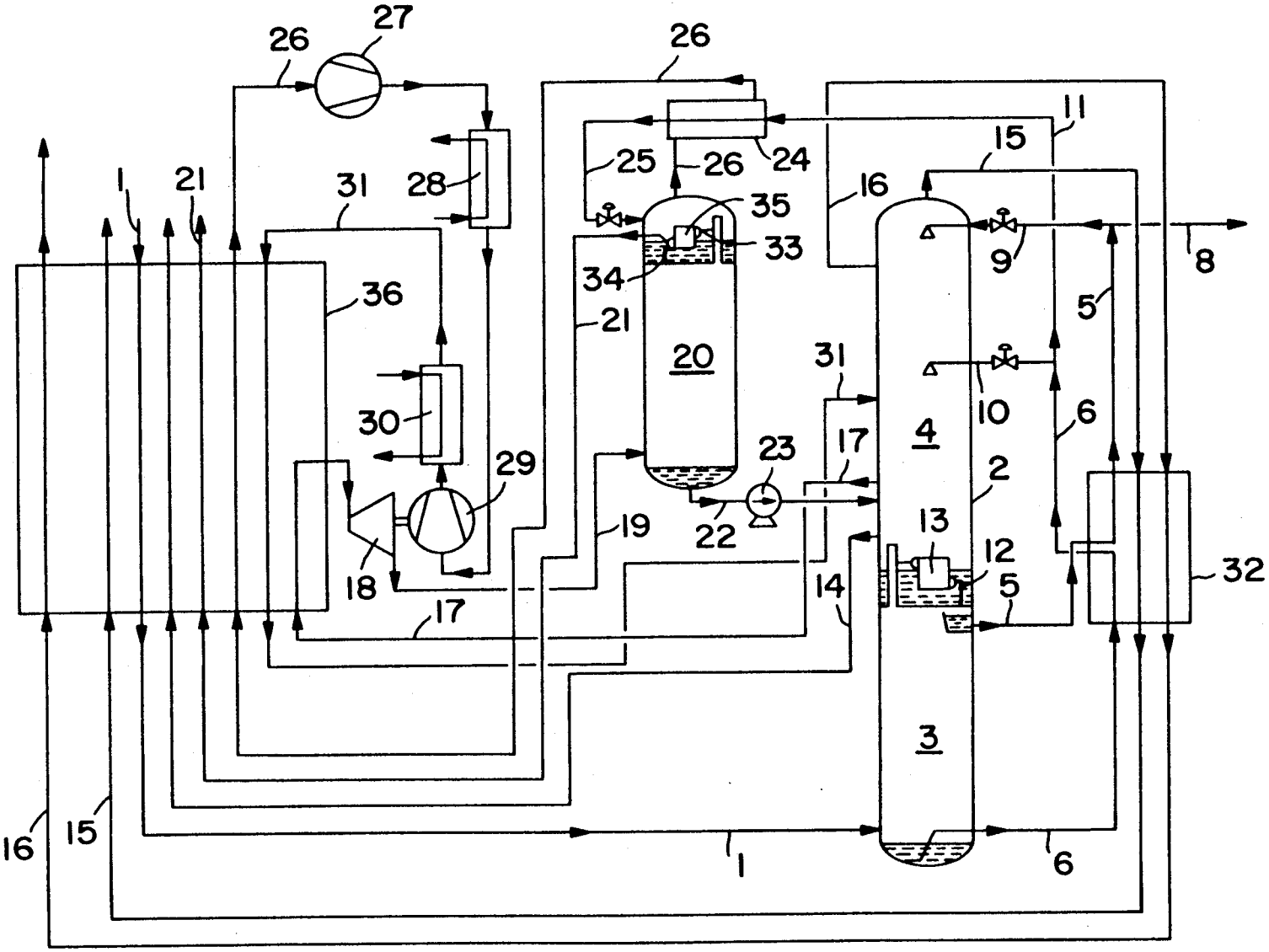
32
8
5
6
11
15
9
10
2
12
5
6
4
13
3
16
31
17
14
24
35
33
23
1
26
26
20
22
25
34
21
19
29
28
17
27
30
18
31
36
26
21
1
15
16

AIR SEPARATION WITH ARGON RECOVERY

BACKGROUND OF THE INVENTION

This invention relates to a process and apparatus for air separation by rectification, including argon rectification.

A process, in which raw argon is recovered following an air separation, is known from DE-OS 34 36 897. Air is compressed, prepurified, cooled and preseparated in the high pressure stage of a two-stage rectification into a nitrogen-rich fraction and an oxygen-rich liquid and both fractions are fed at least partially to the low-pressure stage of the rectification and separated into oxygen and nitrogen. An argon-containing oxygen stream is removed from the low-pressure stage and conveyed to a raw argon rectification stage. In this process, the raw argon rectification is performed at the pressure at which the argon-containing oxygen fraction is removed from the low-pressure stage, which is typical for this type of system. Liquid oxygen is then fed back from the raw argon rectification to about the same location of the low-pressure stage where the argon-containing oxygen fraction is withdrawn.

Such a process is advantageous if the low-pressure stage and the raw argon rectification are both performed substantially at atmospheric pressure. But in many cases, the oxygen and/or nitrogen that are produced in the low-pressure stage are needed at superatmospheric pressures, for example, in coal gasification plants or for the injection of nitrogen in the extraction of crude oil or natural gas. In such cases, for the production of compressed nitrogen and/or compressed oxygen it is economically more advantageous to operate the low-pressure stage at an increased pressure, about 2.0 to 8.0 bars, than to subsequently compress the products recovered at substantially atmospheric pressure. In the known processes, the raw argon rectification must also be performed under such increased pressures; however, under increased pressures lower argon yields are obtained from the crude argon rectification.

SUMMARY OF THE INVENTION

Objects of this invention, therefore, are to provide an improved process and apparatus for the production of compressed nitrogen and/or compressed oxygen, as well as for the recovery of argon.

Upon further study of the specification and appended claims, further objects and advantages of this invention will become apparent to those skilled in the art.

To attain these objects, the raw argon rectification is performed at a pressure lower than the pressure of the low-pressure stage.

In this way, the pressure conditions of the raw argon rectification are no longer tied to those of the low-pressure stage, so that a value of 1.1 to 2.0 bars, preferably 1.3 to 1.5 bars, optimal for the argon yield, can be maintained. Nevertheless, the low-pressure stage can continue to provide oxygen and nitrogen at increased pressures. In general, the difference in pressure between the low-pressure stage and the crude argon rectification is at least 0.3, preferably at least 0.5, bars.

In the process according to the invention, it is especially advantageous if the argon-containing oxygen stream is work expanded before being introduced into the raw argon rectification column. The energy recovered during the expansion can then be used to compress other process streams. Further, by virtue of the work expansion, e.g., a substantially isotropic expansion in a turbine, a large amount of cold gas is produced. In this way, the requirement for external refrigeration can be substantially reduced.

According to another aspect of the invention, it is advantageous to warm the argon-containing oxygen stream before work expansion. This can be performed in heat exchange with other process streams, preferably with the air to be separated.

The residual fraction of the raw argon rectification, which accumulates generally as a liquid, consists essentially of oxygen. Since it would be uneconomical to discard this fraction, another advantageous aspect of the invention comprises pumping the liquid fraction from the raw argon rectification to the pressure of the low-pressure stage and passing resultant pumped liquid back into the low-pressure stage.

It is also advantageous for the gaseous fraction removed from the head of the raw argon rectification to be condensed in indirect heat exchange with evaporating, oxygen-rich liquid from the high-pressure stage. In this way, the cooling values of said liquid can be utilized to form reflux for the raw argon rectification, thereby eliminating or reducing the need for external refrigeration for this purpose. The resultant evaporated, oxygen-rich fraction thus produced is advantageously fed back to the low-pressure stage. However, the evaporated, oxygen-rich fraction must be compressed before introduction into the low-pressure stage; and, to accomplish this, according to another embodiment of the process according to the invention, the energy recovered during the work expansion of the argon-containing oxygen stream is used at least partially to compress the evaporated, oxygen-rich fraction. For this purpose, it is also advantageous to cool the evaporated, oxygen-rich fraction after compression so that the temperature of the compressed gaseous fraction can be lowered to the temperature of the low-pressure column.

The invention further relates to apparatus for performing the process comprising a double rectification column formed from a high-pressure column and a low-pressure column; a raw argon rectification column; first and second conduit means communicating the low-pressure column with the raw argon rectification column, preferably the first conduit means is at a level in the latter column which is higher than the second conduit means; and expansion means integral with the first conduit means. A further feature comprises the incorporation of a pump in the second conduit means. According to a still further feature, a heat exchanger is connected to the raw argon rectification column and with the high-pressure column by a first gas pipe, and by a first liquid pipe, and by a second liquid pipe, and by a second gas pipe that connects the heat exchanger to the low-pressure column. Still another feature incorporates a compressor in the second gas pipe. In addition, it is advantageous for the expansion means to comprise a turbine, and for the latter to be coupled mechanically to the compressor in the second gas pipe.

BRIEF DESCRIPTION OF THE DRAWINGS

Various other objects, features and attendant advantages of the present invention will be more fully appreciated as the same becomes better understood when considered in conjunction with the accompanying drawing, in which like reference characters designate the same or similar parts throughout the several views, and wherein the attached figure is a schematic representation of a preferred comprehensive embodiment of the invention which incorporates many independently novel features.

DETAILED DESCRIPTION OF THE DRAWING

Compressed and prepurified air is introduced by pipe 1, cooled in a heat exchanger 36 in indirect heat exchange with product streams, and fed into the high pressure stage 3 of a two-stage rectification column 2. The high-pressure stage 3 (operating pressure: 6 to 20 bars, preferably 8 to 17 bars) is in indirect heat-exchange relationship with a low-pressure stage 4 (operating pressure: 1.5 to 10 bars, preferably 2.0 to 8.0 bars) by a common condenser/evaporator 13. The introduced air is preseparated in high-pressure stage 3 into nitrogen and an oxygen-enriched fraction. The oxygen-enriched fraction is removed in the liquid state by pipe 6, supercooled in heat exchanger 32 and partially passed into the low-pressure stage 4 by branched pipe 10. Nitrogen from the head of the high-pressure stage 3 is also removed in liquid form by pipe 5, supercooled in heat exchanger 32 and partially removed by pipe 8 as liquid product. The other part of the nitrogen from the high-pressure stage 3 is fed by pipe 9 as reflux to the low-pressure stage 4.

As products of the low-pressure stage 4, liquid oxygen (via pipe 14), gaseous pure nitrogen (via pipe 15) and impure nitrogen (via pipe 16) are removed and heated in heat exchanger 36, with the nitrogen streams being additionally preheated in heat exchanger 32.

In addition to the streams described above, an argon-containing oxygen stream is removed from the low-pressure stage 4 by pipe 17, heated in heat exchanger 36 and introduced into a raw argon rectification column 20 which is operated at a pressure of 1.1 bars to 2.0 bars, preferably 1.3 to 1.5 bars. The residual fraction accumulating at the bottom of the raw argon rectification column 20 is removed by pipe 22 and, according to the invention, is brought by pump 23 to the pressure necessary for feeding it back into the low-pressure stage 4. Furthermore, the argon-rich oxygen stream in conduit 17 is work expanded in an expansion turbine 18 before being introduced into the raw argon rectification column 20 in order to bring the stream to the lower pressure prevailing in the raw argon rectification column 20, as well as to produce process cold values, i.e., refrigeration for the process.

The gaseous raw argon accumulating at the head of the raw argon rectification column 20 is introduced by pipe 33 into a condenser 35, partially liquefied, and one part of the liquid is fed back by pipe 34 as reflux into the raw argon rectification column 20, and the other part is removed by pipe 21 as a crude argon product after being heated in heat exchanger 36.

The condenser 35 is cooled by introducing, via branched conduit 11, a part of the oxygen-rich fraction withdrawn in conduit 6 from the high-pressure stage. This is accomplished by supercooling the oxygen-rich fraction in a heat exchanger 24 and passing it via pipe 25 to condenser 35. The portion evaporated by indirect heat exchange with the head gas from the raw argon rectification is removed by pipe 26 and heated in heat exchangers 24 and 36.

Since it would be economically disadvantageous to discard the oxygen contained in the stream emanating from the bottom of the high-pressure column, it is fed back, according to the depicted embodiment, to the low-pressure stage 4. To reach the pressure necessary for such recycling, the oxygen-rich stream is compressed in two compressor stages 27 and 29 and then cooled in each case (water-fed coolers 28 and 30). Next, the oxygen-rich stream is conveyed by pipe 31 through heat exchanger 36, again cooled there and then fed into the low-pressure stage 4. Here it is advantageous to use the energy recovered by the expansion of the argon-rich oxygen fraction in conduit 17 to operate compressor 29.

Before being introduced into the high-pressure stage 3, a part of the air in pipe 1 can be condensed in heat exchange with oxygen from the bottom of the low-pressure stage 4. The liquid from the bottom of the low-pressure stage can be brought for this purpose to a higher pressure by a pump and can be partially evaporated during the heat exchange. The partially condensed air is then introduced into the high-pressure stage 3 above the first feed point (pipe 1) shown in the drawing. This part of the process is not represented in the drawing, but can be economically advantageous at the indicated rectification pressures.

For an economical argon yield it is necessary to produce the oxygen product (pipe 14) at a purity of at least 99.5%, so as to enrich the argon-rich oxygen stream (pipe 17) with sufficient argon. At 5 bars of pressure in low-pressure stage 4, in a conventional process, an air factor of 5.86 is necessary to provide these conditions. In the process according to the invention, however, the air factor is reduced to 5.45. Thus, an energy saving of 7.0% is achieved.

The entire disclosure of all applications, patents and publications, cited above, and of corresponding German application P 39 03 753.3, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process of air separation by rectification, wherein air is compressed, prepurified, cooled and preseparated in a high-pressure stage of a two-stage rectification into a nitrogen-rich fraction and an oxygen-rich liquid, both fractions are fed at least partially to a low-pressure stage of said two-stage rectification and separated into oxygen and nitrogen, and an argon-containing oxygen stream is removed from said low-pressure stage and fed to a raw argon rectification stage wherein said argon-containing oxygen stream is subjected to rectification, the improvement which comprises conducting said raw argon rectification stage at a pressure lower than the pressure of said low-pressure stage and said argon-containing oxygen stream is work-expanded before being introduced into said raw argon rectification stage.

2. A process according to claim 1, wherein said argon-containing oxygen stream is heated before the work expansion.

3. A process according to claim 2, wherein a gaseous fraction from the head of said raw argon rectification stage is condensed in indirect heat exchange with evaporating, oxygen-rich liquid from said high-pressure stage.

4. A process according to claim 3, wherein the resultant evaporated, oxygen-rich fraction is fed to said low-pressure stage.

5. A process according to claim 4, wherein the resultant evaporated, oxygen-rich fraction is compressed before introduction into said low-pressure stage.

6. A process according to claim 1, wherein a residual liquid fraction recovered from the bottom of said raw argon rectification stage is pumped to the pressure of said low-pressure stage and then fed into said low-pressure stage.

7. A process according to claim 6, wherein a gaseous fraction from the head of said raw argon rectification stage is condensed in indirect heat exchange with evaporating, oxygen-rich liquid from said high-pressure stage.

8. A process according to claim 1, wherein a gaseous fraction from the head of said raw argon rectification stage is condensed in indirect heat exchange with evaporating, oxygen-rich liquid from said high-pressure stage.

9. A process according to claim 8, wherein the resultant evaporated, oxygen-rich fraction is fed to said low-pressure stage.

10. A process according to claim 9, wherein the resultant evaporated, oxygen-rich fraction is compressed before introduction into said low-pressure stage.

11. A process according to claim 10, wherein energy is recovered from the work expansion of said argon-containing oxygen stream and said energy is used at least partially to compress said evaporated, oxygen-rich fraction.

12. A process according to claim 11, wherein said evaporated, oxygen-rich fraction is cooled after the compression.

13. A process according to claim 10, wherein said evaporated, oxygen-rich fraction is cooled after the compression.

14. A process according to claim 1, wherein the pressure difference between said low-pressure stage and said raw argon rectification stage is at least 0.3 bar.

15. A process according to claim 1, wherein the pressure difference between said low-pressure stage and said raw argon rectification stage is at least 0.5 bar.

16. A process according to claim 1, wherein said raw argon rectification stage is operated under a pressure of 1.1–2.0 bar, said high-pressure stage is operated under a pressure of 6–20 bar, and said low-pressure stage is operated under a pressure of 1.5–10 bar.

17. A process according to claim 1, further comprising:

introducing a portion of said oxygen-rich liquid from said high-pressure stage into a condenser zone in the head of said raw argon rectification stage;

subjecting said oxygen-rich liquid fraction to indirect heat exchange in said condenser zone with a gaseous fraction produced by rectification in said raw argon rectification stage, whereby an evaporated fraction and a liquid fraction are formed in said condenser zone;

removing said evaporated fraction from said condenser zone and subjecting said evaporated fraction to indirect heat exchange with said oxygen-rich liquid from said high-pressure stage;

heating, compressing and cooling said evaporated fraction; and delivering said evaporated fraction to said low-pressure stage.

18. A process according to claim 17, wherein a portion of the energy required for compression of said evaporated fraction is provided by work expansion of said argon-containing oxygen stream prior to the latter being introduced into said raw argon rectification stage.

19. Apparatus suitable for separating air into oxygen, nitrogen and argon, comprising:

a double rectification column comprising a high-pressure stage and a low-pressure stage;

a raw argon rectification column first and second conduit means communicating said low-pressure stage with said raw argon rectification column; and work expansion means incorporated in said first conduit means.

20. Apparatus according to claim 19, further comprising a pump incorporated in said second conduit means.

21. Apparatus according to claim 20, further comprising a heat exchanger connecting said raw argon rectification column with said high-pressure stage by a first gas pipe, said heat exchanger also connecting said low-pressure stage by a first liquid pipe, a second liquid pipe, and a second gas pipe, and a compressor being incorporated in said second gas pipe.

22. Apparatus according to claim 19 further comprising a heat exchanger connecting said raw argon rectification column with said high-pressure stage by a first gas pipe, said heat exchanger also connecting said low-pressure stage by a first liquid pipe, a second liquid pipe, and a second gas pipe, and a compressor being incorporated in said second gas pipe.

23. Apparatus according to claim 22, said expansion means comprising an expansion turbine, the latter being coupled mechanically to said compressor in said second gas pipe.

24. In a process of air separation by rectification, wherein air is compressed, prepurified, cooled and preseparated in a high-pressure stage of a two-stage rectification into a nitrogen-rich fraction and an oxygen-rich liquid, both fractions are fed at least partially to a low-pressure stage of said two-stage rectification and separated into oxygen and nitrogen, and an argon-containing oxygen stream is removed from said low-pressure stage and fed to a raw argon rectification stage wherein said argon-containing oxygen stream is subjected to rectification, the improvement which comprises:

conducting said raw argon rectification stage at a pressure lower than the pressure of the low-pressure stage;

subjecting at least a portion of said oxygen-rich liquid from said high-pressure stage to indirect heat exchange with a gaseous head fraction from the head of said raw argon rectification column, whereby said oxygen-rich liquid is at least partially evaporated to form a liquid fraction and an evaporated gaseous fraction; and compressing said evaporated gaseous fraction before introduction thereof into said low-pressure stage.

25. In a process of air separation by rectification, wherein air is compressed, prepurified, cooled and preseparated in a high-pressure stage of a two-stage rectification into a nitrogen-rich fraction and an oxygen-rich liquid, both fractions are fed at least partially to a low-pressure stage of said two-stage rectification and separated into oxygen and nitrogen, and an argon-containing oxygen stream is removed from said low-pressure stage and fed to a raw argon rectification stage wherein said argon-containing oxygen stream is subjected to rectification, the improvement which comprises:

conducting said raw argon rectification stage at a pressure lower than the pressure of said low-pressure stage; and removing a residual liquid fraction from the bottom of said raw argon rectification stage, increasing the pressure of said residual liquid fraction to the pressure of said low-pressure stage, and introducing said residual liquid fraction into said low-pressure stage.

26. In a process of air separation by rectification, wherein air is compressed, prepurified, cooled and preseparated in a high-pressure stage of a two-stage rectification into a nitrogen-rich fraction and an oxygen-rich liquid, both fractions are fed at least partially to a low-pressure stage of said two-stage rectification and separated into oxygen and nitrogen, and an argon-containing oxygen stream is removed from said low-pressure stage and fed to a raw argon rectification stage wherein said argon-containing oxygen stream is subjected to rectification, the improvement which comprises:

conducting said raw argon rectification stage at a pressure lower than the pressure of said low-pressure stage;

subjecting at least a portion of said oxygen-rich liquid to indirect heat exchange with a gaseous head fraction from said raw argon rectification stage to form a liquid fraction and an evaporated gaseous fraction;

subjecting said argon-containing oxygen stream to work expansion before being introduced into said raw argon rectification stage; and compressing said evaporated gaseous fraction, wherein at least a portion of the energy used for compression of said evaporated gaseous fraction is obtained by said work expansion of said argon-containing oxygen stream.

27. In a process of air separation by rectification, wherein air is compressed, prepurified, cooled and preseparated in a high-pressure stage of a two-stage rectification into a nitrogen-rich fraction and an oxygen-rich liquid, both fractions are fed at least partially to a low-pressure stage of said two-stage rectification and separated into oxygen and nitrogen, and an argon-containing oxygen stream is removed from said low-pressure stage and fed to a raw argon rectification stage wherein said argon-containing oxygen stream is subjected to rectification, the improvement which comprises:

conducting said raw argon rectification stage at a pressure which is at least 0.5 bar lower than the pressure of said low-pressure stage, and recovering a crude argon product stream from said raw argon rectification stage.

28. A process according to claim 27, wherein said raw argon rectification stage is operated at a pressure which is at least 0.7 bar lower than the pressure of said low-pressure stage.

* * * * *